United States Patent [19]

Phelps

[11] 4,450,630

[45] May 29, 1984

[54] PAPER MACHINE DRYING SECTION

[75] Inventor: Richard W. Phelps, Fulton, N.Y.

[73] Assignee: The Black Clawson Company, Middletown, Ohio

[21] Appl. No.: 362,190

[22] Filed: Mar. 26, 1982

[51] Int. Cl.[3] ..... F26B 13/00

[52] U.S. Cl. ..... 34/116; 34/121; 162/273

[58] Field of Search ..... 34/116, 117, 118, 121; 162/273, 274, 200

[56] References Cited

U.S. PATENT DOCUMENTS 2,870,692 1/1959 Wisner et al. ..... 162/354

3,600,273 8/1971 McCarrick et al. ..... 162/358

*Primary Examiner*—Larry I. Schwartz

*Assistant Examiner*—David W. Westphal

*Attorney, Agent, or Firm*—Biebel, French & Nauman

[57] ABSTRACT

A dryer section of a paper machine includes a frame having vertical frame members and upper side members spaced to receive endless or looped wires therebetween for supporting the web, with one of the upper side members having a removable block portion near each end thereof and a cantilever support attached to a second upper member. A plurality of drums for drying the web and rolls for supporting and directing the wires include a plurality of drum pairs, each pair rotatably supported by a pivotal support assembly detachably connected to the upper frame members and having a removable block portion along one side thereof between the drums of the pair mounted thereto. The pivotal support assemblies may be detached from the upper frame members and pivoted downwardly until the drum pairs are supported by a lower cantilever sub-structure disposed near the bottom of the drying section, whereupon after removal of all removable block portions, a clear path for replacement of the wires is provided.

14 Claims, 10 Drawing Figures

PAPER MACHINE DRYING SECTION

BACKGROUND OF THE INVENTION

In a Fourdrinier paper making machine, it is common to mount the components located within the endless forming wire on a frame which is supported by spaced cantilevered beams and removable blocks to facilitate replacement of the wire. Such an arrangement is disclosed in U.S. Pat. No. 2,870,692, issued Jan. 27, 1959, to Wisner et al. The removal of the blocks provides a clear path for the insertion of the new wire into the machine.

The technique of cantilevered beams and removable blocks is also commonly used in the press section of a paper machine for supporting one or more press rolls and felt guide rolls within an endless felt. To replace the felt, the ends of the cantilevered beams supported by the removable blocks are lifted slightly with an overhead crane, and the blocks are removed to provide a clearance space for inserting the new felt after the beams are released by the crane.

Another method for replacing the felt is disclosed in U.S. Pat. No. 3,600,273, issued Aug. 17, 1971, to McCarrick et al, wherein hydraulic jacks built into the frame of the press section lift a portion of the frame, thereby providing a clearance space between opposed press rolls. Removable blocks are also provided, and the felt is partially inserted, the jacks are lowered, and the felt is moved on into place in the section. This construction eliminates the need for an overhead crane.

A primary difference between replacement of a forming wire and a press felt is that the felt is required to travel a far more complex path as it moves around the various press rolls and guide rolls. Many serious problems in felt-changing may be avoided, however, since due to the flexible nature of the felt, it may be twisted, gathered or bunched as it is worked into place.

Similar considerations are present with respect to the dryer section of a paper making machine. Traditional dryer sections consist of a number of dryer drums arranged so that the web to be dried passes through the section with one side of the web contacting the first drum, the second side of the web contacting the second drum, and so forth. Felts are also frequently used to provide support for the web as it moves between the drying drums.

Drying of the web within the dryer section is dependent upon three factors, time, temperature and pressure. Drying time may be controlled within the section by either the speed of the web traveling through the section, or the number of drying drums provided therein. Provisions for control of temperature within the section may also be made.

It is known to provide pressure on the web while on the dryer drum surfaces to improve the drying of the web within the section. The desirability of providing pressure on the web, and also of providing support for the web within the dryer section, may be occasioned by a number of factors, including the composition of the pulp and/or the desired speed of operation. For example, hardwood pulps are coming into greater use in the manufacture of board material, such as corrugated board, and it is desirable to employ metal wires such as bronze wires, for example, in the dryer section. Such wires are characterized by openness and by good heat conductivity. It is also desirable in such instances to provide substantially full support for the web, so that the web is not required to make any substantial unsupported run within the dryer section.

A further instance where dryer wires, as described above, are desirable is in very high speed dryer applications such as high speed newsprint machines where the web does not yet have sufficient strength to traverse unsupported spans. Such wires may, for example, be up to 300" wide or more and present particular problems in inserting and changing wires within the dryer section.

It is a further desirable in dryer sections of the general type described to provide as compact an arrangement of dryer drums as possible. Where wires are used, it is often desirable to run the wires at relatively high tension in order to obtain a desired unit pressure per a given area, such as a required pressure in pounds per square inch on the surface of the drums.

The only way that such pressure can be maintained is to cause the wires to wrap the curved surfaces of the drums while under tension, and to eliminate as much as feasible the stages where the wires are running straight, where the unit pressure drops to zero. Thus the dryer designs are such that the dryer drums are relatively closely spaced with respect to each other, increasing the difficulty of reclothing or threading the dryer sections with new wire.

The mere provision of removable blocks, or jacks for lifting a portion of the frame, would be insufficient to provide adequately for replacement of the wires, since a clear, direct path for insertion of the wires into the section is required. Unlike the case of felts, no twisting, bending or gathering of the wires can be permitted to insert them into the section, since kinks will be formed therein. In presently known dryer sections, therefore, these restrictions necessitate virtual dismantling of the section in order to replace the wires.

It is seen, therefore, that a dryer section is needed in which the supporting wires may be replaced in a relatively simple manner. Such a dryer section would make practical the use of wires rather than felts, thereby promoting use of simple means for applying pressure to the web to improve the drying thereof.

SUMMARY OF THE INVENTION

The present invention is directed to an improved paper machine dryer section which incorporates a cantilever structure for supporting one or more dryer drums and a plurality of guide rolls within a pair of endless web-supporting wires, providing for relatively quick and convenient replacement of the wires. In accordance with the preferred embodiment of the invention, the dryer section incorporates a frame having vertical frame members and an upper cantilever sub-structure including upper side members spaced to receive endless looped wires therebetween. One of the upper side members has a cantilever support attached to the second of the upper frame members, and further has a removable block portion near each end thereof.

A plurality of drums for drying the web and rolls for supporting and directing the wires are included a plurality of dryer drum assemblies. Each assembly includes a pair of dryer drums rotatably supported by a pivotal support arm detachably connected to the upper cantilever sub-structure and pivotally attached to a lateral pair of the vertical frame members. Additionally, the support arm has a removable block portion along one side thereof, located between the drums of the drum pair mounted thereto. A lower cantilever sub-structure is mounted near the bottom of the dryer section. The pivotal support arm may be detached from the upper frame members and pivoted downwardly from a normal operating position until the drum assemblies are supported by the pivotal mount and the lower cantilever sub-structure. Upon removal of all removable block portions, a clear path for convenient replacement of the upper and lower wire loops is provided.

The dryer section may also include a latching means mounted to one lateral pair of the vertical frame members. One of the dryer drum assemblies, pivotally mounted to the lateral pair of frame members, may upon detachment from the upper cantilever sub-structure be pivoted upwardly to a position adjacent the lateral frame member pair, where it is retained by the latching means. A center dryer drum is rotatably supported by a pair of support members pivotally mounted to the upper cantilever sub-structure.

Upon engagement of the one drum assembly with the latching means, the center drum may be pivotally moved theretowards. A second drum assembly mounted to a second lateral pair of vertical frame members will then be provided with sufficient clearance and may be pivoted downwardly to a position resting upon the lower cantilever sub-structure. The center drum may then be pivotally moved away from the first drum assembly, thereby providing clearance for that assembly to be released from the latching means and pivoted downwardly to the support block.

Guide rolls are provided for guiding and supporting the lower wire loop, each roll being removably and rotatably supported by a lateral pair of the vertical frame members. The lower cantilever sub-structure includes roll storage means thereon for accepting the guide rolls inside the loop, which are removable from the vertical frame members to the storage means so as to provide for replacement of the lower wire loop.

The five-drum arrangement of the preferred embodiment provides a structure in which only a single drum need be carried on the upper portion of the dryer when the same is in its cantilevered condition, that is, when the spacer blocks have been removed and the wire is being threaded in place, thus limiting the weight which must be carried by the upper cantilever sub-structure during the changing process. Also, the five-drum arrangement has the advantage of duplication of structural parts between the right and left hand sides, providing a cost savings.

Accordingly, it is an object of the present invention to provide a paper machine dryer section which includes a frame having a cantilever supported upper side member with removable block portions therein, a plurality of dryer drums and guide rolls including a plurality of dryer drum assemblies including a pair of dryer drums, each assembly pivotally attached to the frame, and a lower cantilever sub-structure, such that the drum assemblies may be pivoted downwardly from a normal operating position until the wire installation side is supported by the pivotal mount and the lower cantilever sub-structure, so as to provide upon removal of the removable block portions for convenient replacement of the wire loops; to provide such a dryer section in which the wire loops may be maintained under tension so as to provide pressure to the web on the dryer drum surfaces, thereby facilitating drying of the web; and to provide such a dryer section in which the wire loops may be replaced without any risk of damage thereto.

Other objects and advantages of the invention will be apparent from the following description, the accompanying drawings, and the appended claims.

DESCRIPTION OF THE PREFERRED EMBODIMENT

Figure 1:
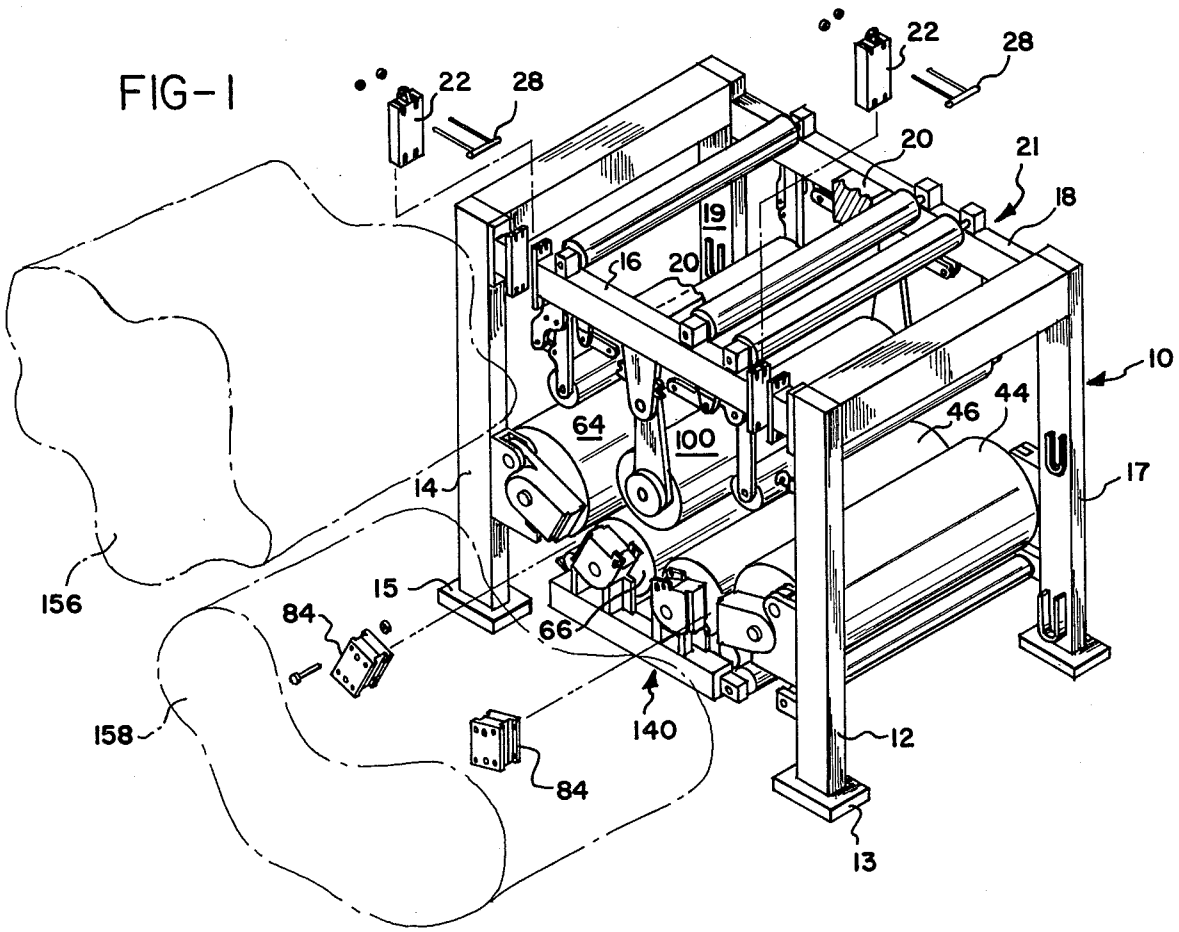
FIG. 1 is a perspective view of a paper machine dryer section constructed in accordance with the present invention.

The paper machine dryer section shown in perspective in FIG. 1 generally includes a main outer frame 10 having front vertical frame members 12 and 14 and a horizontally extending first upper side frame 16 supported by vertical members 12 and 14. Frame 10 further includes a second upper side frame member 18, supported at each end thereof by a pair of rear vertical frame members 17 and 19. Vertical members 12 and 14 are mounted to foot plates 13 and 15, respectively, with the rear vertical members 17 and 19 mounted one each to similar foot plates. Upper side frame members 16 and 18, connected at their mid-points by cantilever support beam 20, constitute an upper cantilever sub-structure 21.

Figure 8:
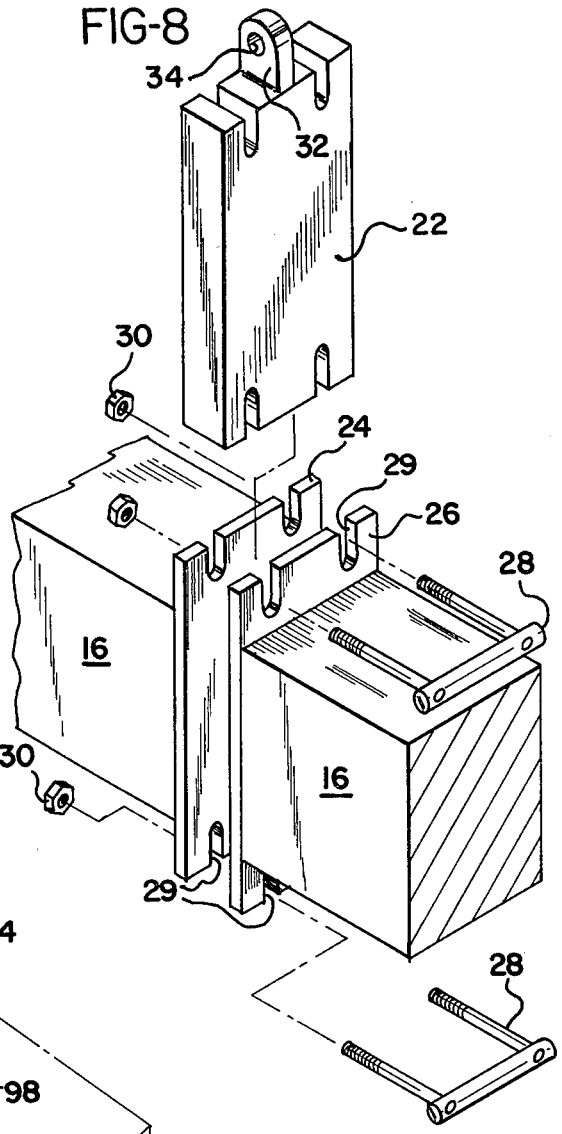
FIG. 8 is a section of the upper side frame member taken in perspective and generally along line 8—8 of FIG. 2.

Upper side frame member 16 includes a removable portion 22 near end end thereof. As shown in FIG. 8, frame member 16 further includes attachment plates 24 and 26 disposed perpendicular to frame member 16, and abutting each removable portion 22. Removable portion 22 is mounted between attachment plates 24 and 26 by a U-bolt member 28, fittable within notches 29 in plates 24 and 26, and fastened by nuts 30. A lifting tab 32 is attached to the top of each removable portion 22, having a hole 34 therein to facilitate removal of portion 22 by an overhead crane.

Figure 2:
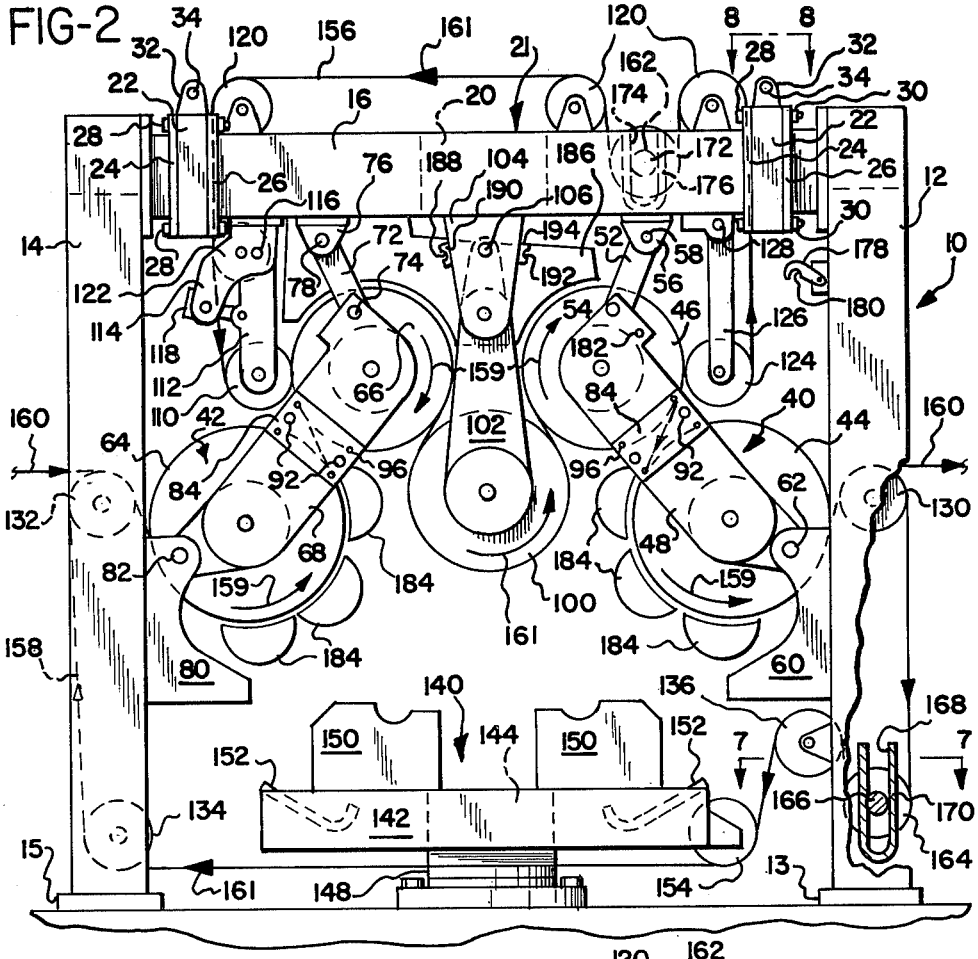
FIG. 2 is an elevational view of the front or forward side of the dryer section.

Referring now to FIG. 2, the dryer section includes a plurality of dryer drum assemblies 40 and 42 mounted to the dryer section frame 10. Assembly 40 includes a pair of dryer drums 44 and 46, rotatably mounted on a front support arm 48 and a rear mounting member (not shown). Support arm 48 is detachably connected to upper frame member 16 of the upper cantilever sub-structure 21 by support means including member 52.

Support arm 48 is connected to member 52 by removable pin 54, and member 52 is pivotally mounted to projection 56 of cantilever sub-structure 21 by pin 58. Support arm 58 is also connected to vertical frame member 12 by means pivotally supporting one end thereof comprising support brace 60 and pin 62. Support brace 60 is in turn mounted to vertical frame member 12. It will be understood that the rear support arm is connected to frame 10 in a substantially similar manner.

Likewise, assembly 42 includes a pair of dryer drums 64 and 66, rotatably mounted on a front support arm 68 and a rear support arm (not shown). Front support arm 68 is detachably connected to member 72 by removable pin 74. Member 72 is connected to projection 76 of upper cantilever sub-structure 21 by pin 78. Support arm 68 is pivotally connected to vertical frame member 14 by attachment to support brace 80 by pin 82. Support brace 80 is in turn mounted to vertical frame member 14.

Figure 9:
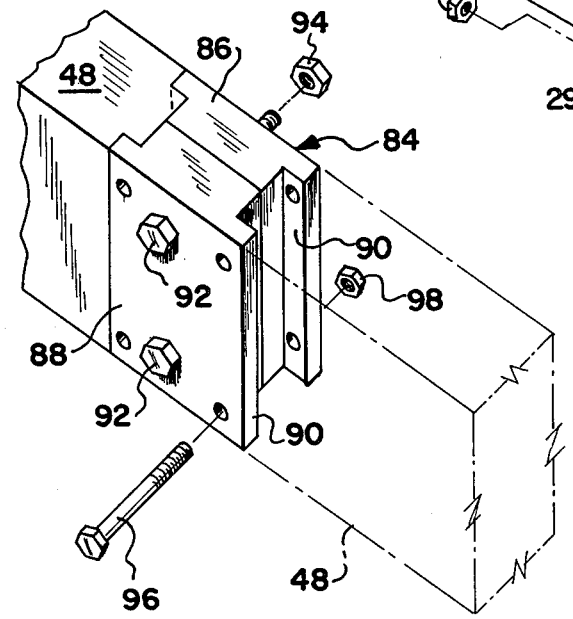
FIG. 9 is a section of the dryer drum pair support arm, taken in perspective and generally along line 9—9 of FIG. 3.

Each of support arms 48 and 68 includes a removable block portion 84 disposed therein between the drums of drum assemblies 40 and 42. As shown in FIG. 9, removable block portion 84 includes an inner flanged block 86 and an outer flanged block 88. Blocks 86 and 88 are connected by screws 92 fastened with nuts 94. Removable block portions 84 are secured within support arms 48 and 68 by bolts 96, passing through flanges 90, secured with nuts 98.

Referring again to FIG. 2, a center drum 100 is pivotally supported from upper cantilever sub-structure 21, and is normally disposed between drum assemblies 40 and 42. Center drum 100 is rotatably mounted to drum support members 102, which are pivotally connected to arms 104. Arms 104 are in turn mounted one each to upper frame members 16 and 18. Support members 102, and thus drum 100, are maintained in a center position by bolts 106, secured by nuts 108, passing through support members 102 and arms 104.

A pressure roll 110 is disposed normally in contact with dryer drum 66, also supported by cantilever sub-structure 21. Roll 110 is rotatably mounted to mounting member 112, which is in turn pivotally mounted to attachment member 114 by pin 116. Attachment member 114 is fixedly mounted to upper frame member 16. A fluid pressure cylinder 118 is connected to a lower portion of attachment member 114 and has its piston rod connected to mounting member 112, so as to apply a selected amount of pressure to the web on dryer drum 66 by pressure roll 110.

A plurality of guide rolls 120 are rotatably mounted to upper cantilever sub-structure 21. A guide roll 122 is mounted to attachment member 114, and a guide roll 124 is rotatably supported by arms 126, pivotally mounted to upper frame members 16 and 18 by pins 128. A lower guide roll 130 is removably mounted to vertical frame member 12, and a pair of lower guide rolls 132 and 134 are removably mounted to vertical frame member 14. Further, a lower guide roll 136 is fixedly rotatably mounted to vertical frame member 12.

Figure 6:
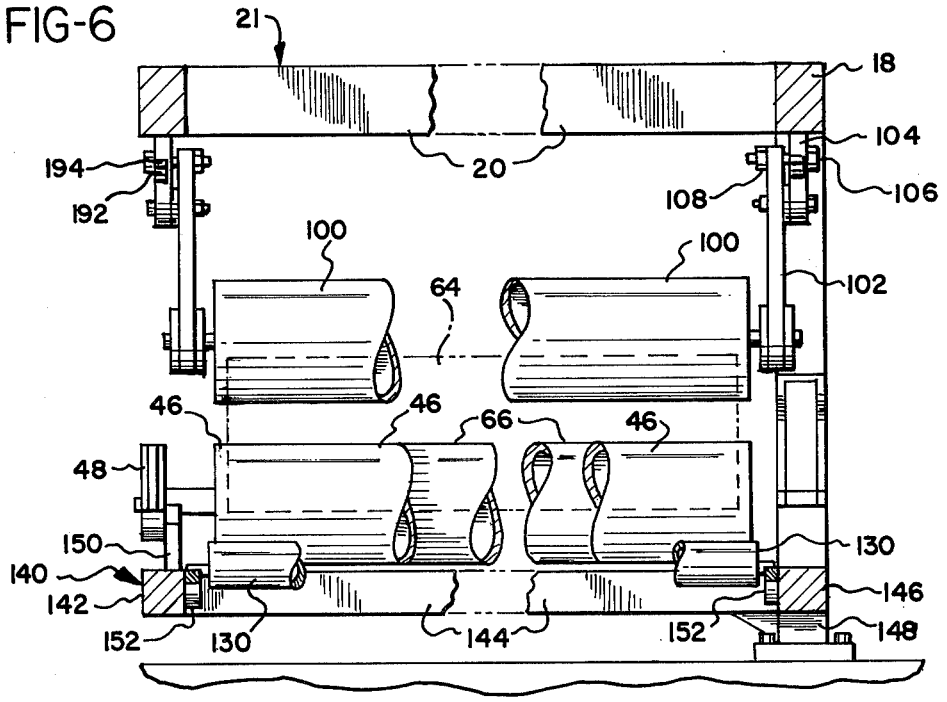
FIG. 6 is a partial sectonal view taken generally along the line 6—6 of FIG. 5, with the guide rolls removed from the roll storage means and the heater hood removed.

The dryer section further includes a cantilever substructure 140, disposed near the bottom of the section. As seen in FIG. 6, lower cantilever sub-structure 140 includes a front side member 142, attached by cantilever means including beam 144 to rear side member 146. Rear side member 146 is connected to support legs 148. Substructure 140 further includes guide roll storage means, comprising a plurality of J-shaped support flanges 152, disposed along the inner surface of side members 142 and 146, one each at the ends thereof. Additionally, a guide roll 154 is fixedly rotatably mounted to one end of side members 142 and 146.

Figure 10:
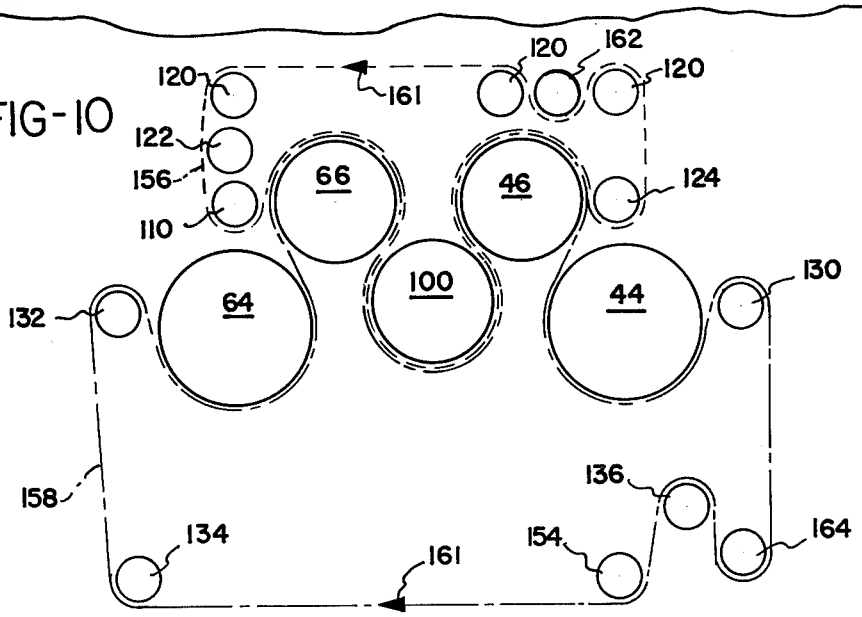
FIG. 10 is a schematic view of the drums and rolls, illustrating the paths of the wire loops.

The dryer section further includes an endless upper wire 156. As shown in FIG. 10, wire 156 passes around pressure roll 110, over dryer drums 66, 100 and 46, and over guide rolls 124, 120 and 122. A lower endless wire 158 passes around dryer drums 64, 66, 100, 46 and 44, passes around guide roll 130 and over guide rolls 136 and 154, passes below cantilever sub-structure 140, and around guide rolls 134 and 132.

Preferably, wires 156 and 158 constitute metal wires. While the dryer section of the present invention is particularly suited for use with metal wires, however, it should be recognized that any fabric or web material other than metal suitable for tensioning and running as a wire may be substitute.

The five-drum dryer of the preferred embodiment, with pairs of dryer means carried on drum assemblies, facilitates the use of drive means (not shown) as disclosed in U.S. Pat. No. 4,181,039, issued Jan. 1, 1980 to Phelps. The drive means includes one drive unit drivingly connected to the drums of each drum assembly 40 and 42, mounted to the rear mounting members thereof, for rotating drums 44, 46, 64 and 66 in the directions indicated by arrows 159 in FIG. 2. Rotation by the drive means of the drums moves the web through the dryer section, as shown by arrows 160, as well as driving wires 156 and 158 in the directions indicated by arrows 161. It will be noted that center dryer drum 100 is not driven, but rather is freely rotatable.

Figure 7:
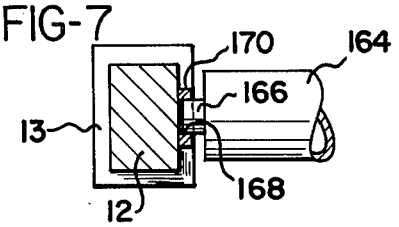
FIG. 7 is a fragmentary section taken generally along the line 7—7 of FIG. 2.

Tension is maintained in wires 156 and 158 by means of tension rolls 162 and 164. Lower wire 158 passes around tension roll 164, which is rotatably and removably mounted to vertical frame member 12 as shown in FIG. 7. Rolls 164 has a shaft 166, the end of which is slidably fitted into a U-shaped slot 168 defined by a flange member 170. Similarly, upper wire 156 passes around tension roll 162, rotatably mounted to upper cantilever sub-structure 21. Shaft 172 of roll 162 is slidably contained within U-shaped slot 174, defined along the inner sides of upper frame members 16 and 18 by flange member 176.

A latching means 178 is mounted to verticcal frame member 12, and has a hooking surface 180 defined therein. Hooking surface 180 is engageable with a pin 182 mounted to support arm 48 of the drum assembly 40. Upon disconnection of drum pair 40 from arm 52, drum assembly 40 may be pivoted around pin 62 upwardly towards vertical frame member 12. Upon placement of drum pair 40 in a position adjacent vertical frame member 12, drum assembly 40 may be retained therein by engagement of latch means 178 with pin 182.

The dryer section further includes auxiliary heat supply means for supplying additional heat to the web passing therethrough, so as to accelerate the drying thereof. A plurality of heater bars 184 are disposed within the drying section adjacent drums 44 and 64. Heater bars 184 are mounted within the drying section so as to be removable from the rear thereof to facilitate replacement of wires 156 and 158.

Additionally, a heater hood 186 is pivotally mounted to upper cantilever substructure 21, disposed so as to provide heat to the web along the surfaces of drums 46 and 66. Hood 186 may be pivoted slightly upwardly, so as to provide adequate clearance for the movement of drum assemblies 40 and 42 as will be described below.

The preparation of the dryer section for replacement of the wires 156 and 158 is described below. It will be understood that all lifting, movement, and so forth of the various drying section components is generally to be performed by use of an overhead crane.

Figure 3:
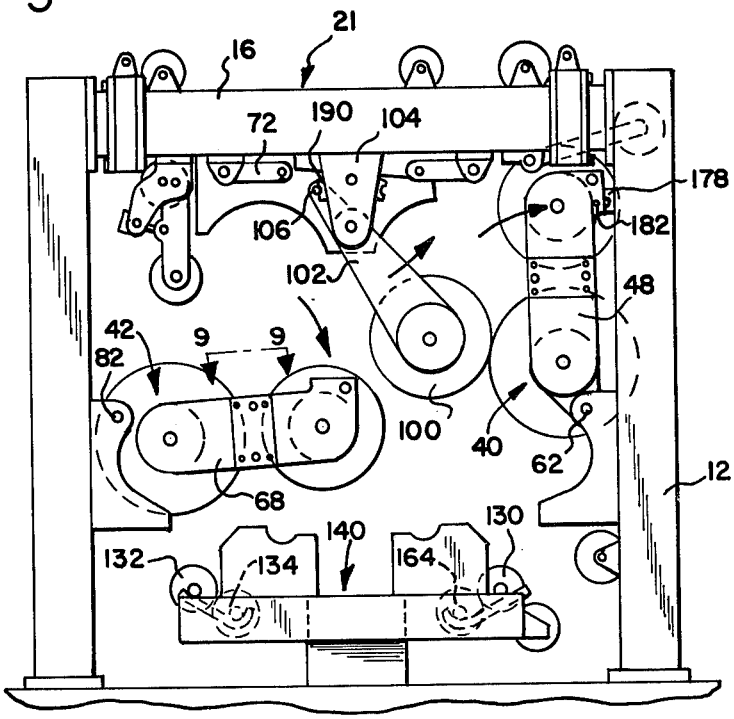
FIG. 3 is a view as in FIG. 2, showing a portion of the preparation of the dryer section for replacement of the wire loops.

Initially, heater bars 184 are removed from the rear of the drying section, and hook 186 is pivoted upward slightly. As can be seen in FIG. 3, guide rolls 130, 132 and 134 and tension roll 164 are removed from their normal positions to the roll storage means in lower cantilever substructure 140. Tension roll 162 is removed from its normal position between upper frame members 16 and 18.

Support arm 48 for drum assembly 40 is detached from member 52 by removal of pin 54. Drum assembly 40 is then pivoted upwardly about pin 62, to a position adjacent vertical frame member 12. Latching means 178, engaging with pin 182, is used to retain drum assembly 40 in that position. Bolt 106 is removed from support member 102 and mounting member 104, thereby permitting center drum 100 to be pivoted. Center drum 100 is then pivoted toward drum assembly 40, providing clearance for pivotal lowering of drum assembly 42. Bolt 106 is then replaced into support member 102, engaging with a notch 188 defined within a retaining block 190 mounted to one side of mounting member 104, thereby retaining center drum 100 in the position illustrated in FIG. 3.

Figure 4:
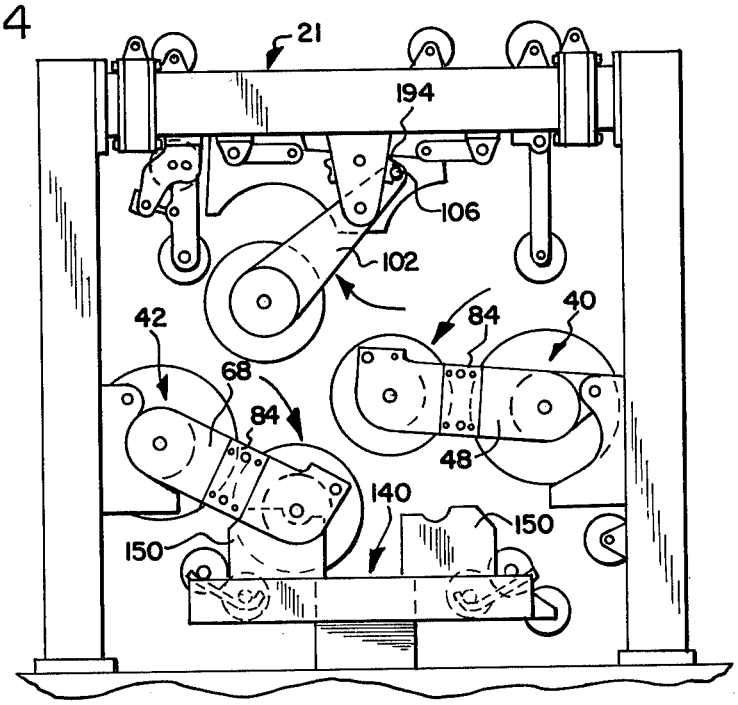
FIG. 4 is a partial view as in FIG. 2, showing a portion of the preparation of the dryer section for replacement of the wire loops.

Support arm 68 supporting drum assembly 42 is then detached from member 72 by removal of pin 74. Drum assembly 42 is pivoted downwardly about pin 82 until the assembly 42 rests upon support members 150 of lower cantilever sub-structure 140, as shown in FIG. 4. Bolt 106 is then removed from support member 102, and center drum 100 is pivoted away from drum assembly 40 to a position as shown in FIG. 4. Bolt 106 is then reinserted into support member 102, engaging with a notch 192 defined within another retainer block 194 mounted to an opposite side of mounting member 104, thereby holding drum 100 in position. Drum assembly 40 is then released from latching means 178 and pivoted downwardly until drum assembly 40 is supported by supporting members 150 of cantilever sub-structure 140.

Figure 5:
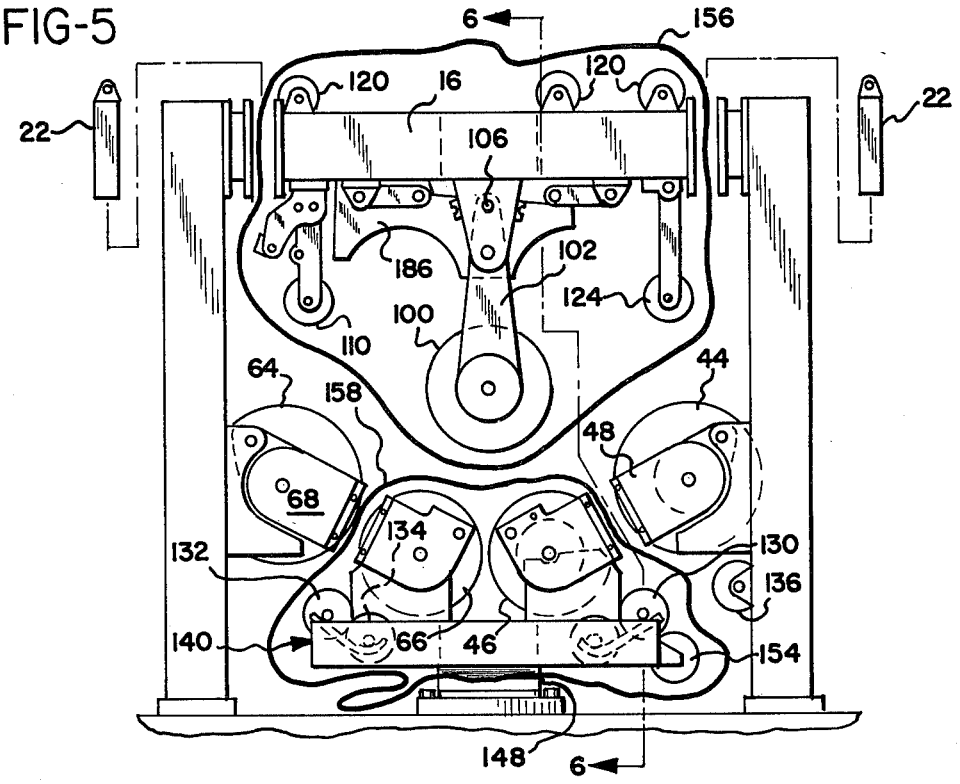
FIG. 5 is a view as in FIG. 2, showing the dryer section prepared for the replacement of the wire loops.

Referring now to FIG. 5, bolt 106 is again removed from support member 102, and center drum 100 is returned to its normal position. Bolts 96 are removed from removable block portions 84 of support arms 48 and 68, thereby allowing removal of block portions 84. Bolts 28 are removed from removable block portions 22 of upper frame members 16, similarly allowing block portions 22 to be removed. Upon removal of these portions, the dryer section is prepared for removal of old wires 156 and 158, and insertion of new, replacement wires.

It will be recognized that returning the dryer section to a normal operating condition following replacement of the wires is accomplished by reversal of the steps described above.

While the form of the apparatus herein described constitutes a preferred embodiment of the invention, it is to be understood that the invention is not limited to this precise form of apparatus, and that changes may be made therein without departing from the scope of the invention.

What is claimed is:

1. A paper machine dryer section for use in combination with a pair of endless wires including an upper wire and a lower wire supporting a paper web therebetween, comprising:

a frame, including substantially vertical frame members spaced laterally to receive the wires and web therebetween, and a pair of substantially parallel, horizontal upper side frame members, each extending longitudinally between the tops of two of said vertical frame members, a first of said upper members having cantilever support means therefor attached to the second of said upper frame members, said first member further having removable portions near each end thereof, said dryer section having a plurality of heated drums for drying the web and a plurality of rolls for supporting and directing the wires, including a plurality of drum assemblies, each of said drum assemblies including a pair of drums mounted on an arm in spaced relation to each other, means pivotally supporting one end of said drum assembly support arms to one of said vertical frame members providing for movement of said drum assemblies between a normally raised, operative position and a lowered wire changing position, support means normally supporting said arms and said pairs of drums in said normally raised position, a lower cantilever sub-structure positioned adjacent the bottom of said dryer section and positioned to engage said drum assemblies when said assemblies are moved to said lowered position, and removable portions between each of the pairs of drums on said drum assembly arms providing for the threading of the lower said wire therethrough when said drum assemblies are supported on said cantilever sub-structure in said lowered position.

2. A dryer section as defined in claim 1 further comprising latching means mounted to a first lateral pair of said vertical frame members such that one of said drum assemblies pivotally mounted to said lateral pair of said vertical frame members may upon detachment from said upper frame members be pivoted upwardly to a position adjacent said first lateral pair and be retained therein by said latching means.

3. A dryer section as defined in claim 2, wherein said drums further include a center drum rotatably supported by a pair of drum support members pivotally mounted to said upper frame members, such that upon engagement of said one drum assembly with said latching means, said center drum may be pivotally moved theretowards, thereby providing clearance space through which another said drum assembly mounted to a second lateral pair of said vertical frame members may be pivoted downwardly to said cantilever sub-structure, whereupon said center drum may be pivotally moved toward said second lateral pair, thereby again providing clearance space through which said one drum assembly may be pivoted downwardly to said cantilever sub-structure after release from said latching means.

4. A dryer section as defined in claim 1, wherein said support means normally supporting said arms and said pairs of drums in said normally raised position detachably connects each said arm to said first upper frame member.

5. A dryer section as defined in claim 4 further comprising a plurality of support braces, one each of said support braces being attached to such of said vertical frame members as have one said arm of said drum assemblies mounted thereto, said support braces being attached below the mounting point of said arm so as to provide partial support for said pair of drums in the lowered position thereof.

6. A dryer section as defined in claim 1, wherein said rolls include a plurality of guide rolls for guiding and supporting the lower wire, each said guide roll being removably and rotatably supported by a lateral pair of said vertical frame members, and wherein said cantilever sub-structure includes roll storage means thereon for accepting said guide rolls, said guide rolls being removable from said vertical frame members to said storage means so as to provide for convenient replacement of the lower wire.

7. A dryer section as defined in claim 1, wherein said rolls include at least one pressure roll having a support means therefor attached to said frame, said support means being disposed so as to maintain said pressure roll in a pressure relationship with one said drum of said drum assemblies, such that the web passes therebetween.

8. A paper machine dryer section for drying a paper web, comprising:

a plurality of drums for drying the web, at least one drum assembly for rotatably supporting at least one of said drums, each said drum assembly including a removable portion, a pair of endless wires including an upper and a lower wire for supporting the web therebetween, said wires passing partially around end of said drums, a plurality of rolls for supporting and directing said wires, a frame constructed so as to pass the web and said wires therethrough, rotatably supporting said rolls, and having each said drum assembly pivotally mounted thereto, and a lower cantilever sub-structure mounted near the bottom of said dryer section such that each said drum assembly may be pivoted downwardly until said one drum supported thereby is supported by said cantilever sub-structure, so as to provide upon removal of said removable portion for convenient replacement of said wires.

9. In a paper machine dryer section having a frame constructed so as to pass a paper web therethrough and a plurality of rotatable drums for drying the web, the improvement comprising:

a pair of endless wires including an upper and a lower wire for supporting the web therebetween, said wires passing partially around each of said drums, a plurality of rolls for supporting and directing said wires, said rolls being rotatably mounted to said frame, at least one drum assembly for rotatably supporting at least one of said drums, each said assembly being pivotally mounted to said frame and including a removable portion, and a lower cantilever sub-structure mounted near the bottom of said dryer section, said cantilever sub-structure being so mounted that each said drum assembly may be pivoted downwardly until said one drum supported thereby is supported by said cantilever sub-structure, so as to provide upon removal of said removable portion for convenient replacement of said wires.

10. A dryer section as defined in claim 9, wherein each said drum assembly rotatably supports a pair of said dryer drums, and further includes a removable portion along one side thereof between the drums of said pair, said portion being removable to facilitate replacement of said wires.

11. An improved dryer section for a paper machine for supporting upper and lower endless wires therein and providing for ease of change of said wires, comprising:

a frame, said frame having substantially vertical frame members, a pair of substantially parallel, generally horizontal upper side frame members extending longitudinally between said vertical frame members, cantilever means supporting one of said upper frame members from the other of said upper frame members, said one frame member further having means defining a pair of removable portions therein positioned substantially adjacent the ends thereof, a plurality of drums for drying the web and rolls for supporting and directing the wire loops including a first drum assembly having a pair of drying drums thereon, means pivotally supporting said first drum assembly from one of said vertical frame members, a second drum assembly having a second pair of drying drums thereon, means pivotally supporting said second drum assembly from the other of said frame members, removable support means associated with each of said drum assemblies and normally supporting said drum assemblies in a first position, means in each of said pivotal supports for said drum assemblies defining a removable block for forming an access opening between the pair of drums thereon, a lower sub-structure underlying said drum assemblies, and cantilever means supporting said sub-structure to one side of said frame leaving said sub-structure open and unsupported at the opposite end thereof, said sub-structure being positioned in underlying relation to said pivotal drum assemblies and proportioned to receive said drum assemblies in a lowered position upon pivotal movement of said drum assemblies about said pivotal support means providing for the threading of said upper wire through said upper member with said removable sections removed and the lower run thereof being positioned above said drum assemblies, and providing for the threading of the lower wire with the lower run thereof below said sub-structure and the upper run thereof extending through said access openings formed in said drum assemblies.

12. In a paper dryer press section which incorporates five dryer drums and an upper and lower paper support fabric in the form of upper and lower endless wires, in which the upper wire has a lower run which engages the second, third and fourth dryer drums and in which the lower wire has an upper run which engages each of the dryer drums, each of the wires having return runs, such that a web of paper entering the dryer section is supported at all times by at least one of the dryer wires prior to exiting the dryer section, the improvement comprising:

a dryer frame, substantially vertical frame members, the upper ends of said vertical frame members being joined longitudinally by generally horizontal upper side frame members extending generally between the tops of two of the vertical frame members, said upper frame side members being attached to each other by a cantilever support, one of said horizontal upper side frame members being connected to the adjacent vertical frame members by means of removable blocks adjacent the longitudinal ends thereof, said dryer drums including a first pair of said drums forming the first and second drums, an intermediate drum forming the third drum and a second pair of said drums forming the fourth and fifth dryer drums, common arms connecting each drum in said pairs of drums, means pivotally supporting one end of one said arm to one of said side frame members, means pivotally supporting one end of the arm of said second pair of drums to the other of said side frame members, support members for said center drum, being mounted to support members, means pivotally mounting said support members to said horizontal upper side frame members, means normally locking said support members in fixed position, means normally supporting each of said pairs of drums in depending relation from said horizontal upper side frame members, one of said arms connecting each said pair of drums having a centrally located removable block portion separating each said drum of said pairs from each other, a generally underlying sub-structure, and means providing cantilever mounting for said sub-structure so that the bottom thereof is elevated above the lower return of said lower wire, said sub-structure having means thereon adapted to receive and support the innermost drums of said pairs of drums comprising drums two and four when said arms are rotated about the pivotal supporting means whereby said removable block portions in said arms may be removed to permit the removal and insertion of said lower wire between said pairs of drums, and whereby the removable blocks of said upper horizontal side frame member may be removed to permit the withdrawal and insertion of the upper wire therethrough.

13. A paper machine dryer section for use in combination with a pair of endless wires including an upper and a lower wire supporting a paper web therebetween, comprising:

a plurality of heated drums for drying the web and a plurality of guide rolls for supporting and directing the wires over successive said drums;

a frame including mans for supporting said drums and said rolls for movement between an operating position and inoperative, wire-changing position;

said frame further including an upper cantilever sub-structure and a lower cantilever sub-structure for at least partially supporting some of said drums and said rolls when in said inoperative positions thereof; and said frame and said support means each including at least one removable portion providing, upon removal in conjunction with placement of said drums and said rolls in said inoperative positions thereof, access to the interior of said section for the convenient replacement of said wires without lateral bending of said wires.

14. A dryer section as defined in claim 13, wherein said support means includes at least one support arm for rotatably mounting at least two of said drums thereon, said arm being pivotally mounted to said frame at one end of said arm, and detachably connected to said frame at the other end thereof, so that upon detachment of said arm from said frame, said drums mounted thereto may be moved from said operating position to said inoperative position; said arm further having a removable portion providing for access between said drums mounted to said arm, to facilitate replacement of said wires.

* * * * *

UNITED STATES PATENT AND TRADEMARK OFFICE

CERTIFICATE OF CORRECTION

PATENT NO. : 4,450,630

DATED : May 29, 1984

INVENTOR(S) : Richard W. Phelps

It is certified that error appears in the above-identified patent and that said Letters Patent is hereby corrected as shown below:

Column 4, line 39, after "frame" insert --member--.

Column 4, line 51, "end", first occurrence, should be --each--.

Column 5, line 4, "58" should be --48--.

Column 6, line 20,"means" should be --drums--.

Column 6, line 37, "rolls" should be --roll--.

Column 12, line 12, "mans" should be --means--.

Signed and Sealed this

*Twenty-seventh* Day of *November 1984*

[SEAL]

*Attest:*

GERALD J. MOSSINGHOFF

*Attesting Officer*

*Commissioner of Patents and Trademarks*